United States Patent [19]

De Bartolo

[11] 4,106,240

[45] Aug. 15, 1978

[54] APPARATUS FOR PRECISELY INDEXING THE ORIENTATION OF A PORTION OF A DEVICE WITH RESPECT TO A SUPPORT STRUCTURE OF THE DEVICE

[76] Inventor: Paul I. De Bartolo, 21 Sylvan Pl., New Rochelle, N.Y. 10801

[21] Appl. No.: 758,165

[22] Filed: Jan. 10, 1977

[51] Int. Cl.[2] ..... B24B 9/16

[52] U.S. Cl. ..... 51/125; 33/172 B; 51/229; 74/826

[58] Field of Search ..... 51/125, 229; 33/172 B, 33/172 D; 74/826

[56] References Cited

U.S. PATENT DOCUMENTS

| | | | |
|---|---|---|---|
| 925,016 | 6/1909 | McMullen | 51/229 |
| 2,921,487 | 1/1960 | Schabot | 74/826 X |
| 3,102,343 | 9/1963 | Plank | 33/172 D |
| 3,439,456 | 4/1969 | Bailey | 51/125 |
| 3,914,869 | 10/1975 | Merz | 33/172 D |

*Primary Examiner*—Harold D. Whitehead

*Attorney, Agent, or Firm*—McAulay, Fields, Fisher & Goldstein

[57] ABSTRACT

An apparatus for precisely indexing the orientation of a portion of a device with respect to a rigid support structure of the device by locking the portion of the device, at a digitally set angle with respect to a reference lever, and thereafter detecting the deviation of the reference lever from an initially set position utilizing a motion amplifying device in combination with a relative position measuring means.

11 Claims, 4 Drawing Figures

APPARATUS FOR PRECISELY INDEXING THE ORIENTATION OF A PORTION OF A DEVICE WITH RESPECT TO A SUPPORT STRUCTURE OF THE DEVICE

BACKGROUND OF THE INVENTION

The invention relates to an apparatus for precisely indexing the orientation of a portion of a device with respect to a rigid structure of the device.

The invention relates more particularly to the use of such a device for re-establishing the faceting angle on a stone being ground in a faceting machine or in any other application wherein the relative orientation between two parts of a device must be repeatedly re-established. Such other uses are intended to include, but not be restricted to such uses as in a surveying transit.

Although the apparatus will be discussed with special emphasis on its use in a faceting machine, as noted above, it is not intended to so restrict its application.

In particular, in order to appreciate fully the inventive advance of the present invention over the prior art systems, consideration is to be given to a number of related devices which are of interest. In this respect, reference is made to U.S. Pat. No. 3,098,327, to Malin, which discloses a grinding and polishing machine for precious or semi-precious stones wherein the relative angle between a reference and a head-portion of the machine is set on a segmental protractor plate by pivoting the head about an axis. Additionally, the reproducible orientation of the protractor segment relative to the support structure of the machine is insured by means of a mechanical stop comprising a slot which engages a projection or stud.

Another faceting device using a protractor and pivot for setting the relative angles between the faceting head and a reference arm is shown in the U.S. Pat. No. 2,724,220 to Shaw. Although a relatively crude device, the arrangement used by Shaw shows the basic method which has normally been employed to set the relative angle between the faceting head and any reference arm. The device shown in the U.S. Pat. No. 3,940,888 to Wain is almost identical to the device of Shaw, in this respect.

Another patent of interest is U.S. Pat. No. 3,102,343 to Plank, showing a measuring apparatus for machine tools wherein a scanning portion of the device may be rotated about a test piece while the indicating mechanism remains stationary for easy reading. A multiple lever system is used to transmit motions of the scanning probe which deviate from a circle. The device according to Plank does not contemplate nor provide for precisely indexing the orientation of two portions of a device with respect to each other. Deviation from a circular norm rather than reproducibility of a preset angular orientation, appears to be the function of the Plank Device.

Another patent of interest is the U.S. Pat. No. 3,507,047 to Staedele for a nil gauging device for machine tools, in particular for setting-up work on milling machines, drilling machines or the like. The nil gauging device is intended for use in aligning the central axis of a drill chuck with a reference mandrel and with the edge of a work piece to determine a zero position. The deviation from the aligned position is transmitted to the pointer of a gauge by means of a dual lever mechanism. The eccentricity of the drill chuck or similar device is determined by rotating the drill chuck while the nil gauging device according to Staedele is in contact with the edge of the work piece and can be corrected for by relative adjustment of the work piece to the device. No means is provided in the Staedele reference teachings for locking together, at a pre-determined angle, different portions of a device, and thereafter indexing the orientation of these portions of the device with respect to a support structure of the device.

A further patent which is of interest is U.S. Pat. No. 3,811,229 to Montgomery, showing a gem faceter. This patent, similar to the Mailin patent and the Shaw patent, discussed above, sets the angle between the faceter head and a reference protractor by rotating the head or dop about a shaft until a pointer indicates the desired cutting angle on a protractor. To monitor the position of the support member or the cutting head, as an indication of when the grinding is completed, a sensor is mounted on a stop to provide a signal which is translated by an electrical circuit to a visual indication of the relative position of the support arm and the sensor. No levers or other mechanical means appear to be provided to amplify the relative movement between these devices. In fact, as the faceting head is mounted at a point further from the pivot means than is the electrical sensing device, the deviation of the head supported by the lever will be attenuated with respect to the electrical sensor.

SUMMARY OF THE INVENTION

It is an object of the present invention to provide for the precise indexing of the orientation of a portion of a device with respect to a rigid structure of the device.

A further object of the invention is the provision of a digital angle setting means operable to lock a reference lever and the portion of the device together at any one of a predetermined number of angles whereby the orientation of the portion with the reference lever can be precisely duplicated.

A further object of the invention is to provide for a sensitive means to determine when any particular orientation of the reference lever with respect to the support structure of the device, has been duplicated.

A further object of the invention is the provision of a means to determine by how much the reference lever orientation deviates from the predetermined orientation.

A further object of the invention is to provide an improved faceting machine wherein the improvement comprises the inclusion of an apparatus for precisely indexing the orientation of the dop stick of the faceting machine with the grinding disc.

Further objects an advantages of the invention will be set forth in part in the following specification and in part will be obvious therefrom without being specifically referred to, the same being realized and attained as pointed out in the claims hereof.

With the above and other objects of the invention in view, the invention consists in the novel construction, arrangement, and combination of various devices, elements and parts as set forth in the claims hereof, one embodiment of the same being illustrated in the accompanying drawings and described in the specification.

In the context of the present invention, reference is made to a faceting machine which is known, for precisely grinding facets into gemstones. During the grinding process one often raises the dop stick to determine how the grinding is proceeding. It is also necessary to lift the dop stick, and therefore the gemstone, from the grinding disc in order to rotate the gem to a new position for the grinding of another facet. It is desirable, for the optimum light refraction "brilliance," that each of the facets be ground at an identical angle with respect to the axis of the gemstone. To insure that this is accomplished, it is necessary to be able to determine when the orientation of the dop stick, relative to the grinding wheel, has been duplicated for each facet. As has been indicated in the above discussion, in the past this has been accomplished by the use of mechanical stops. The gem is held against the grinding wheel and slowly ground until a reference lever has moved up against a mechanical stop. The presence of dust or other dirt on the mechanical stop can act to introduce errors of a major fraction of a degree into the intended reproduced orientation of the dop stick with respect to the grinding wheel.

In order to eliminate this problem, the instant invention provides for the locking of a dop stick chunk to a reference lever and the continuous determination of the relative position of the reference lever with respect to a support structure including the grinding wheel. The measurement of the relative position of the reference lever is accomplished by transmitting the movement of the reference lever to a relative position indicating device through a second lever. By adjusting the ratio of the length of the lever arm through which the reference lever acts to the length of the lever arm acting on the relative position indicator, the sensitivity of the relative position indicating means to variations in the position of the reference lever can be adjusted.

The present invention can easily be adapted for use in other applications wherein the indexing of the relative position of two portions of a device must be precisely accomplished. An example of such an application is in a surveyor's transit. Other uses would be obvious to persons skilled in the art.

The invention accordingly comprises the features of construction, combination of elements and arrangement of parts which will be examplified in a construction hereinafter setforth and the scope of the application which is indicated in the claims.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENT

Figure 1:
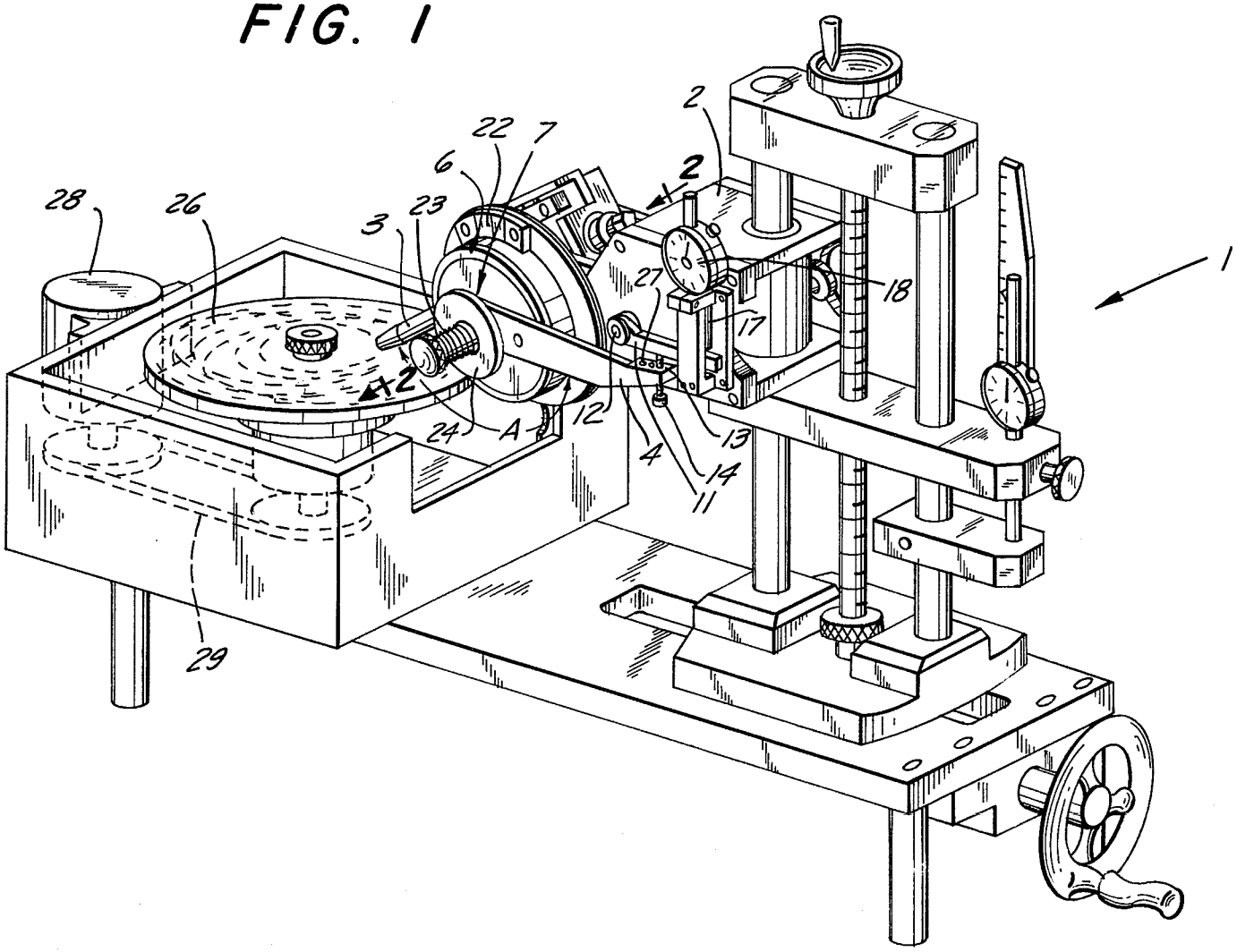
FIG. 1 is a perspective view of the instant invention in combination with a gem faceting device.

In carrying the invention into effect in one of the embodiments which has been selected for illustration in the accompanying drawings and for description in the specification, and referring now particularly to FIG. 1, a gem faceting device 1 has a rigid support structure 2 on which is supported the various parts of the device.

Figure 2:
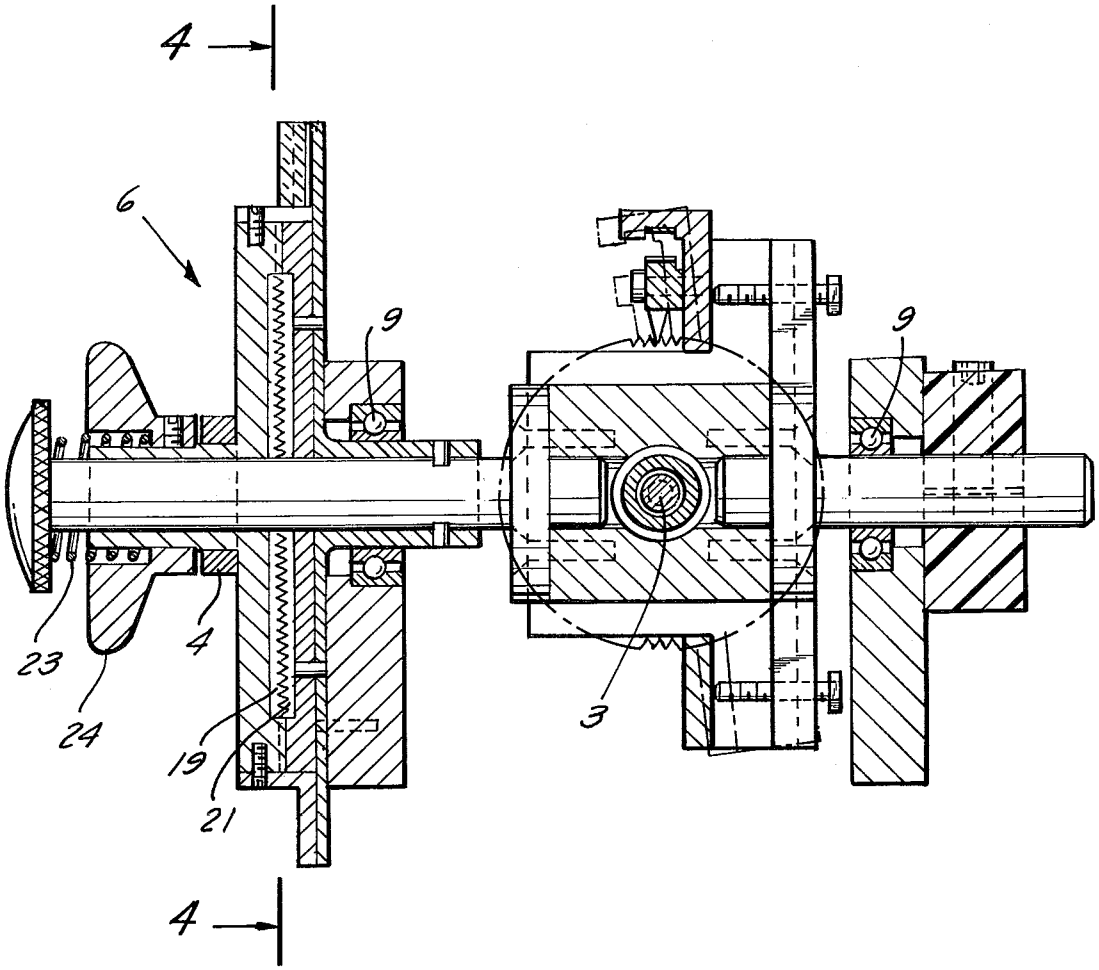
FIG. 2 is a sectional view of the device of FIG. 1 taken through 2 — 2.
Figure 3:
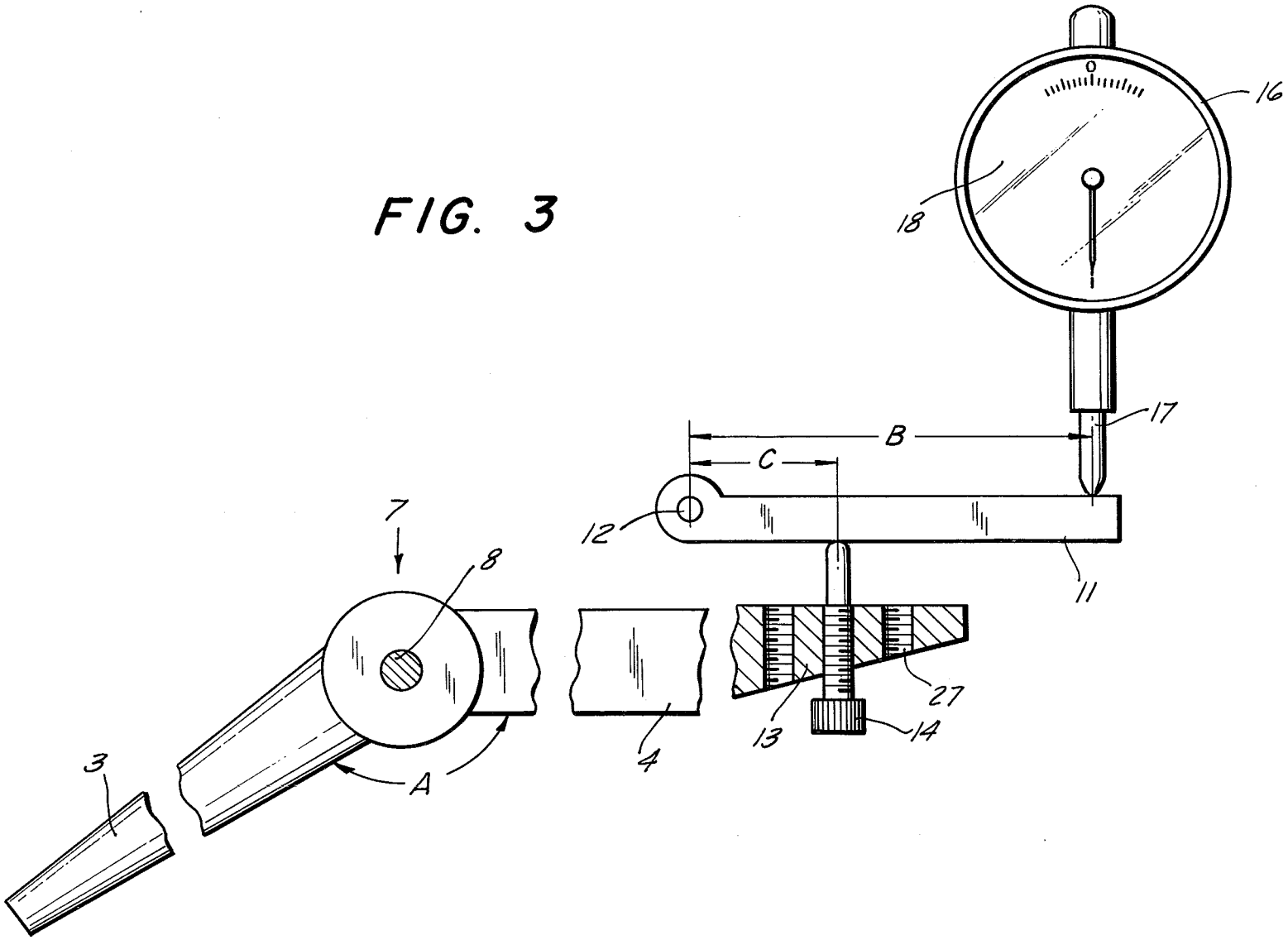
FIG. 3 is a schematic view of a portion of FIG. 1 showing the relation between the dop stick chuck and the relative position indicating means.
Figure 4:
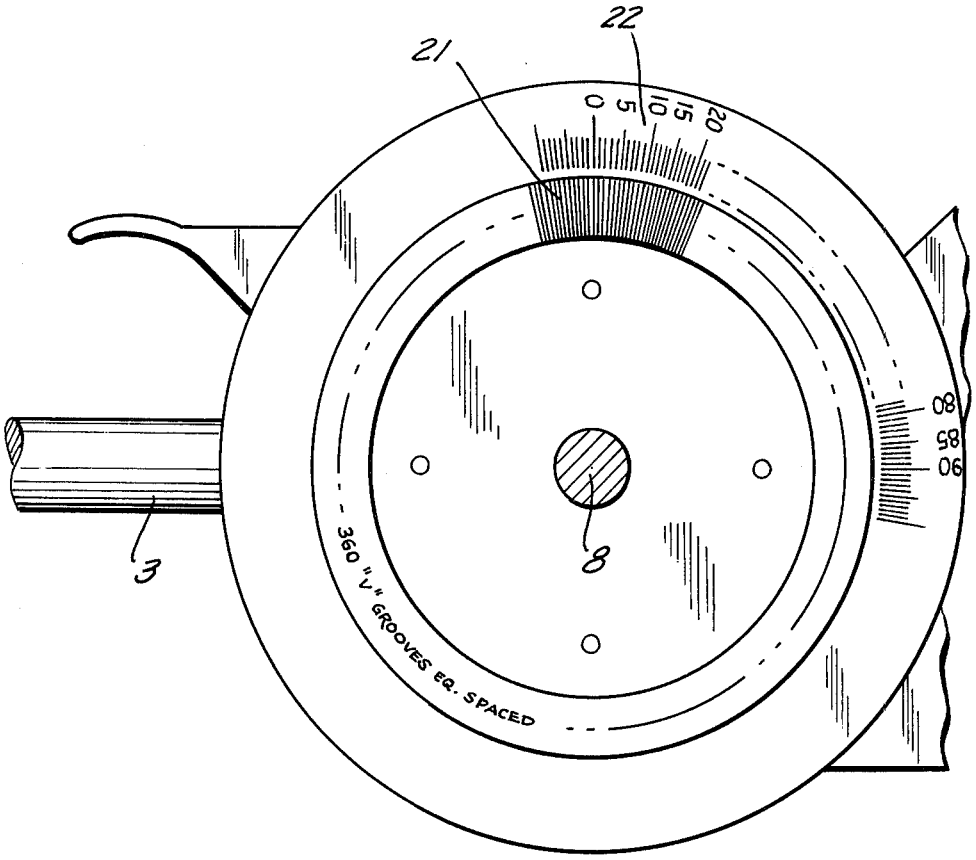
FIG. 4 is a sectional view of the device of FIG. 2 taken along 4 — 4.

A dop stick chuck 3, which is operable in a well known manner to support a dop stick supporting a gemstone for grinding, is locked together with a reference lever 4 by means of a digital angle setting means 6, shown in detail in FIGS. 2 and 4. The thus locked together dop stick chuck 3 and reference lever 4 form a rigid configuration 7 defining an angle A (FIG. 3).

The thus locked together configuration 7 is pivotably secured to the rigid support structure 2 by means of a pivot means 8 (FIG. 3). The pivot means 8 preferably has ball bearing 9 or similar bearing support (FIG. 2) in which the rigid configuration can rotate in a plane.

A second reference lever 11 is rotatably mounted on the rigid support structure by means of a second pivot 12. The second pivot 12 constrains the second reference lever 11 to rotate in a plane substantially parallel to the plane in which the first reference lever 4 rotates. A section 13 of the first pivot lever 4 projects into the plane of rotation of the second reference lever 11 and, by means, preferably, of a pivot point device 14 intersects the second reference lever 11 at a place spaced apart from the second pivot 12.

In the preferred embodiment of FIG. 1, the pivot point device 14 is pressed upwardly against the second reference lever 11 which, in turn, acts against a relative position indicating means such as the indicating micrometer device 16. The device 16 shown in FIG. 1 is a readily available device which quantitatively reflects the displacement of its probe 17 on a meter face 18. The substitution of any other similar device, either mechanical or electrical, as would be obvious to a worker in the art, is within the contemplation of the instant invention.

As can be most clearly seen in the FIG. 2, the digital angle setting means 6 has two gears 19 and 21 having matching face ground teeth which lock the gears 19, 21 together when pressed against each other. If, for example, 360 teeth or grooves are cut into each gear 19, 21, it can be readily seen that the relative orientation of the gears 19, 21 with respect to each other can be precisely set by adding index marks such as degree calibrations 22 (FIG. 4). If the degree calibrations 22 are to accurately reflect the relative orientation of the gears 19, 21, it is, of course, necessary that the teeth be accurately ground and spaced apart by 1° each. Because of the digital nature of the setting of the gears 19, 21 relative to each other, however, the accuracy of the grinding of the teeth only affects the accuracy of the indicator but does not affect the precision by which the setting of the indicator will be reproduced.

The gears 19, 21 are held in engagement with each other in the preferred embodiment shown, by the spring 23. By pulling collar 24 against the spring 23, the gear 19 may be freed from engagement with gear 21 and rotated relative to the gear 21 to adjust the angle A as desired. Release of the collar 24 will permit the spring 23 to force the gears 19, 21 into engagement in one of a predetermined number of possible orientations dictated by the number of different relative orientations in which the teeth of the gear 19 will engage the teeth of the gear 21.

OPERATION

The operation of the above described embodiment of the invention is as follows:

In the preferred embodiment, the first reference lever 4 is normally disposed substantially parallel to the grinding surface 26. This can be accomplished by any well known method.

The pivot point device is preferably a threaded rod which may be screwed into threaded holes 27 provided in the section 13 of the first pivot lever 4. By adjusting the amount of which the threaded rod 14 extends above the first reference lever 4, or by other well known means, a null reading can be obtained on the indicating micrometer device 16 which is acted upon through the pivot point device 14 by the second reference lever 11.

The second reference lever 11 acts to amplify the displacement or movement of the first reference lever 4. This can be seen most clearly with reference to FIG. 3. The pivot point device 14 acts against the second reference lever 11 at a first place on the reference lever 11 displaced from the second pivot 12 by a distance C. The second reference lever 11 acts against the probe 17 at a place displaced from the second pivot 12 by a distance B. As can easily be seen, the motion of the first reference lever 4 is increased by a factor directly proportional to the ratio of the distance B to the distance C. By moving the pivot point device 14 to a different threaded hole 27, the distance C can be adjusted and therefore the apparent sensitivity of the relative position indicating means 16 to the motions of the first reference lever 4.

As the first reference lever 4 and the grinding surface 26 are normally parallel to each other and substantially horizontal, the angle A between the dop stick chuck 3 and the first reference lever 4 substantially reflects the relative orientation of the dop stick and therefore the gemstone held by the dop stick, to the grinding surface 26. This angle is determined by the angle at which it is desired to grind the facet in the gemstone.

The angle A may be set as discussed above, by pulling on the collar 24 to release the spring 23 from causing the engagement of the gears 19, 21. A protractor indicator 22 may be provided on the gear 21 or any portion of the structure secured to the gear 21, and an indicator mark (not shown) may be provided on the gear 19 or a part of the structure secured to the gear 19 for ease in setting the angle A.

The dop stick chuck 3 may be raised by pivoting about the pivot 8 and a dop stick supporting a gemstone inserted in a known fashion. The dop stick chuck 3 is then returned to its original position with the gemstone against the grinding surface 26. Power to the grounding surface is usually provided via motor 28 and drive belts 29. By observing the reading on the position indicating device 16, one can determine when the facet has been ground to the preset angle A by observing when the null reading is again reached. The dop stick chuck 3 may then be raised and rotated the required number of degrees for the next facet.

It has been found, using this device, that extremely high reproducibility of the angle to which facets are ground, can be obtained. The faceted gemstones produced on a device employing the present invention as described above, appear to be noticeably more "brilliant" or "alive" than faceted gemstones produced on similar devices not employing the present invention.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

1. An apparatus for precisely indexing the orientation of a portion of a device with respect to a rigid support structure of the device, comprising incombination, a first reference lever;

digital angle setting means operable to lock said reference lever and said portion together at any one of a predetermined number of angles relative to each other to form a rigid configuration;

said support structure including a first pivot means pivotably supporting said rigid configuration in substantially a first plane whereby said rigid configuration is constrained to rotate about said first pivot means;

a second reference lever;

second pivot means mounted on said rigid support in fixed special relation to said first pivot means, and pivotably supporting said second reference lever to constrain said second reference lever to rotate in a second plane substantially parallel to said first plane;

said first reference lever including a section projecting into said second plane and intersecting said second reference lever at a predetermined first place whereby rotational movement of said first reference lever is transmitted to said second reference lever, the non-pivotably secured end of the second reference lever extending beyond said first place;

relative position indicating means operably connected to said rigid structure is fixed spacial relation to both said pivot means and to a second place defined on the portion of the second reference lever extending beyond said first place, to indicate relative rotational motion of said second reference lever to said rigid structure.

2. An apparatus, as claimed in claim 1, wherein said digital angle setting means comprises first gear means having raised teeth formed on a raised portion of its face;

second gear means having raised teeth formed on its face and operable to engage said teeth of said first gear means, thereby to lock both said gear means together; and biasing means operable to press said second gear against said first gear to interengage said teeth to form a rigidly locked together configuration.

3. An apparatus as claimed in claim 2 wherein each said gear means has 360 teeth disposed equally spaced apart to define a circle on the face of each said gear.

4. An apparatus as claimed in claim 3 wherein one said gear includes a series of degree calibrations and the other said gear includes an indicator mark.

5. An apparatus as claimed in claim 1 wherein said relative position indicating means comprises an indicating micrometer device.

6. An apparatus for precisely indexing the orientation of a portion of a device with respect to a rigid support structure of the device, comprising in combination, a first reference lever;

digital angle setting means operable to lock said reference lever and said portion together at any one of a predetermined number of angles relative to each other to form a rigid configuration, including first gear means having raised teeth formed on a raised portion of its face, and second gear means having raised teeth formed on a raised portion of its face and operable to engage said teeth of said first gear means thereby to lock both said gear means together, and biasing means operable to press said second gear against said first gear to interengage said teeth thereby to form a rigidly locked together configuration;

pivot means mounted on said support structure to pivotably suport said rigidly locked together configuration;

motion amplifying means including a second lever engaging said first lever and operable to respond with a change in position of increased magnitude, to any change in position transmitted to it by said first lever; and relative position indicating means supported on said support structure in fixed spacial relation to said pivot means and operably connected to said motion amplifying means to provide indication of a change in position of said motion amplifying means with respect to said support structure.

7. An apparatus as claimed in claim 6 in combination with a gem faceting machine and wherein;

said portion of said device comprises a dop stick chuck; and said rigid support structure includes a driven abrasive surface.

8. An apparatus as claimed in claim 6 wherein said relative position indicating means comprises an indicating micrometer device.

9. An apparatus as claimed in claim 1 in combination a gem faceting machine and wherein;

said portion of said device comprises a dop stick chuck;

and said rigid support structure includes a driven abrasive surface.

10. In combination, a gem faceting machine having a dop stick chuck to hold a gem for faceting by grinding, a rigid support structure and driven abrasive surface supported on said rigid support structure; and an apparatus supported on said rigid support structure to support and precisely index the position of said dop stick chuck with respect to the driven abrasive surface thereby to allow precise faceting, by grinding, of the gem; said apparatus comprising in combination;

a reference lever;

digital angle setting means operable to lock said reference lever and said dop stick chuck together at any one of a predetermined number of angles relative to each other to form a rigid configuration wherein the position of said reference lever defines the position of the dop stick chuck; said digital angle setting means comprising first gear means having raised teeth formed on its face, second gear means having raised teeth formed on its face and operable to engage said teeth of said first gear means, thereby to lock both said gear means together, and biasing means operable to press said second gear against said first gear thereby to interengage said teeth to form said rigid configuration;

reference pivot means mounted on said support structure for pivotably supporting said rigid configuration substantially in a reference plane whereby said rigid configuration is constrained to rotate about said reference pivot means; and relative position indicating means supported on said rigid support structure in fixed spacial relation to said reference pivot means and being operable to indicate relative rotational motion of said reference lever to said rigid support structure.

11. In a combination as claimed in claim 10 wherein said relative position indicating means includes a displacement measuring device for measuring relative displacement and a motion amplifying device for amplifying the movement and relative displacement of said reference lever, said motion amplifying device comprising:

a motion amplifying lever;

amplifying pivot means mounted on said rigid support in fixed spacial relation to said reference pivot means, for pivotably supporting said motion amplifying lever and to constrain said motion amplifying lever to rotate in a measuring plane substantially parallel to said first plane;

said reference lever including a section projecting into said measuring plane and intersecting said motion amplifying lever at a predetermined first place whereby rotational movement of said reference lever, and therefore of said dop stick chuck, is transmitted to said motion amplifying lever, the non-pivotably secured end of said motion amplifying lever extending beyond said first place; and said displacement measuring device being operable to measure the displacement of a second place defined on a portion of the motion amplifying lever which extends beyond said first place.

* * * * *